United States Patent [19]

Baril et al.

[11] 4,250,727

[45] Feb. 17, 1981

[54] PROCESS FOR THE PRODUCTION OF THERMOFORMED ARTICLES COMPRISED OF ALUMINUM-BASED AND MAGNESIUM-BASED ALLOYS

[75] Inventors: Jacques Baril, Etang-La ville; Jean-Yves Gaborieau; Philippe Lheureux, both of Velizy, all of France

[73] Assignee: SCAL Societe de Conditionnements en Aluminium, Paris, France

[21] Appl. No.: 933,876

[22] Filed: Aug. 15, 1978

[30] Foreign Application Priority Data

Sep. 5, 1977 [FR] France ..... 77 27533
Nov. 10, 1977 [FR] France ..... 77 34521

[51] Int. Cl.[3] ..... B21D 26/02

[52] U.S. Cl. ..... 72/46; 72/364; 72/700; 148/11.5 A

[58] Field of Search ..... 72/38, 42, 46, 47, 342, 72/364, 700, 56, 60, DIG. 25, DIG. 28, DIG. 30, DIG. 31; 148/6.27, 11.5 A, 11.5 M; 164/14, 72, 73; 29/527.2, DIG. 18, 25, 27, 44; 113/120 A, 120 H; 204/58

[56] References Cited

U.S. PATENT DOCUMENTS 2,116,954 5/1938 Singer ..... 72/46
3,350,907 11/1967 McDonald et al. ..... 72/38
3,584,487 6/1971 Carlson ..... 72/38
4,066,480 1/1978 Gullotti et al. ..... 148/11.5 A

FOREIGN PATENT DOCUMENTS 455077 10/1936 United Kingdom ..... 72/46

OTHER PUBLICATIONS

"Forming of Magnesium Alloys", Metals Handbook, 8th Edition, vol. 4, (1969), pp. 426–429.

IBM Technical Disclosure Bulletin–"Superplastic Tools and Materials", E. C. Uberbacher, Apr. 1969.

*Primary Examiner*—Lowell A. Larson

*Attorney, Agent, or Firm*—Dennison, Meserole, Pollack & Scheiner

[57] ABSTRACT

A process for producing thermoformed articles from thin-walled blanks composed of aluminum or magnesium alloys, the present invention particularly provides for forming a layer of alumina or magnesia on the surfaces of the respective aluminum or magnesium blank. The alumina or magnesia layers so formed are artificially formed in order to obtain desired thicknesses, the regular layers allowing ready removal of the articles from thermoforming molds. The present process is particularly intended for the production of thin-wall packaging members and motor vehicle components.

24 Claims, 3 Drawing Figures

PROCESS FOR THE PRODUCTION OF THERMOFORMED ARTICLES COMPRISED OF ALUMINUM-BASED AND MAGNESIUM-BASED ALLOYS

BACKGROUND OF THE INVENTION

1. Field of the Invention

The invention relates to a process for the production of articles composed of aluminum or magnesium alloys through the use of thermoforming techniques, such techniques including hot plastic deformation of thin-walled blanks by means of a fluid under pressure, the pressure causing the blank to be applied to the surface of a mold.

2. Description of the Prior Art

Thermoforming, a very widely used process in the plastics material industry, comprises the raising of a thin-walled blank, in most cases a cup-shaped member or a simple flat sheet, to an elevated temperature which is lower than the melting temperature of the material being used but which is sufficient to soften that material and to provide it with good plasticity. The desired shape is then imparted to the blank by applying the blank against the surface of a mold by the action of a fluid under pressure. In regard to blanks whose walls are sufficiently malleable at the forming temperature, it is also possible to use simple atmospheric pressure as the forming pressure by creating a vacuum between the blank and the forming surface of the mold.

In recent years, the use of this thermoforming method has been extended to the production of many thin-walled articles formed of special aluminum alloys, these alloys being referred to as "superplastic alloys". Many patents disclose superplastic aluminum alloy compositions and various alternative ways of performing the thermoforming process, among them, French Pat. Nos. 2,004,410, 2,146,847 and 2,245,428.

In such methods of forming thin-walled articles, the periphery of the metal blank is held in place by being gripped between the edges of a two-part mold, the periphery of the blank not being deformed. This gripping action seals the space between the forming surfaces of the mold and the facing surface of the blank with respect to ambient. Only the portion of the blank which is disposed facing the recessed female portion (or projecting male portion) of the mold undergoes plastic deformation by elongation of the metal wall in every direction, no slippage occurring between the periphery of the blank and the edges of the two-part mold gripping said periphery. When plastic materials such as organic plastics are subjected to thermoforming, the forming of the article may be effected either by the action of a fluid under pressure, which pressure is applied to the face of the blank which is to be deformed to provide a hollow configuration, or by forming a vacuum on the face which is to be deformed to provide a projecting relief configuration. However, if it is necessary to form an article from a sheet of metal having a thickness too great to be affected by the differential pressure obtainable by the inducing vacuum and the atmosphere, a relatively substantial fluid pressure must be used to apply the wall of the blank against the surface of the mold.

Thermoforming is typically referred to as positive thermoforming when the mold used is a relief mold, such a mold being, except for contraction of the metal after cooling, of the dimensions of the interior of the article to be produced. When the mold used is a hollow mold which, except for shrinkage, is of the dimensions of the outside of the article to be produced, the process so involved is referred to as negative thermoforming. Through the use of these thermoforming techniques, "superplastic" alloys, as referred to hereinabove, can be subjected to substantial degrees of deformation without rupture, particularly degrees of elongation on the order of 1000 to 2000% at temperatures which are from 0.3 Tf to 0.6 Tf, Tf being the aboslute melting temperature of the alloy being used as the blank. Such alloys make it possible to produce articles whose developed surface area $S_1$ is from 3 to 4 times the surface area $S_0$ of the starting blank. However, deformation of the blank must be slow and requires from 4 to 10 minutes per operation. Thus, this method is not suitable for high-speed production of mass-production products.

According to the present invention, it is demonstrated in contrast to conventional practices in the art and contrary to generally accepted ideas, that a thermoforming process can be used with blanks of current aluminum alloys such as alloys 2002, 3003, 4047, 7020, 8011 and 5754, in accordance with French Standard A02 104. The present invention has also been found to be useful in the formation of thermoformed articles from blanks composed of magnesium alloys.

SUMMARY OF THE INVENTION

The present invention provides a process for thermoforming articles from thin-walled blanks of aluminum and magnesium alloys at "industrial" production rates, the invention particularly teaching the formation of alumina and magnesia surface layers respectively on the aluminum and magnesium alloy blanks so that the thermoformed articles will resist sticking to the molds and can be rapidly disengaged therefrom. In this specification, the term aluminum is used generally to denote aluminum itself and available aluminum-based alloys, such as the alloys mentioned above. In like manner, the term magnesium is used to denote the metal itself and magnesium-based alloys.

When aluminum is used according to the present invention, good results are obtained provided that operation is effected at suitable temperatures of from 400° to 550° C. These temperatures are preferably from 440° C. to 530° C., that is, at absolute temperatures on the order of 0.7 Tf to 0.9 Tf and preferably close to 0.8 Tf. However, it is typically not possible to obtain an elongation of greater than 100% as opposed to 1000 to 2000% for the "superplastic" alloys referred to hereinabove. Similarly, a surface area ratio $S_i/S_0$ on the order of 1.5 is obtained according to the present invention instead of 4 for the "superplastic" alloys. The ratio between depth and width of the deformations is on the order of from 0.2 to 0.3 rather than the greater ratios obtained with "superplastic" alloys. However, the admissible deformation speeds are exceptionally high, the forming time required for forming an article is of the order of from 1 to 10 seconds and permits production rates of from 500 to 1000 articles per hour per mold, rather than the approximately ten articles per mold encountered with "superplastic" alloys. As will be further appreciated, the thermoforming process of the present invention and particularly the application thereof to use with current aluminum alloys differ from thermoforming such as is known with "superplastic" alloys.

In the practice of the present invention, the molds are raised to a temperature which is higher than the temperature for deformation of the blank, which temperature differences may be of the order of 100° C. For this kind of production, it is sufficient to employ fluid at pressures of the order of 1 MPa (Mega Pascal) for sheets which are 2 mm in thickness, and lower than 0.1 MPa, for sheets which are 0.15 mm in thickness. Vacuum may also be used for drawing the metal sheet on to the shaping surface of the mold when the metal is of a sufficiently small thickness.

Thermoforming of current aluminum alloys according to the present invention provides the following industrial advantages:

(1) Since thermoforming machines are light machines in comparison with cold stamping presses, the required investment in machinery and buildings is lower than for conventional stamping equipment;

(2) Since thermoforming machines are less noisy in comparison with conventional presses, noise is reduced in the manufacturing environment;

(3) The thermoforming process according to the present invention makes it possible to produce articles at the same rates as conventional stamping presses when relatively low degrees of deformation are acceptable and wherein the ratio between depth and width is not required to exceed approximately 0.3.

As regards small members, it is even possible to use multiple-cavity molds, which makes it possible to extend the use of this process to the production of articles such as small pots for preserves, which are produced at rates of several thousands of articles per hour. For large components such as those formed for automobile bodywork or for facing the fronts of buildings, the rates of the present process are identical to those of conventional presses, that is to say, of the order of 500 components per hour, taking into account the time for positioning the blank, the time for thermoforming and then the time for removing the molded components from the mold.

Further advantage is seen in the use of the present invention in that it is possible to use aluminum alloys with structural hardening by precipitation which, after hardening and maturing or tempering, have mechanical characteristics which are equal to or better than those of the extra-mild steels which are currently used in conventional stamping operations. Also, articles formed according to the invention are not, after shaping, subject to the phenomenon of "resilient return" or "springback", nor to the existence of internal stresses which give rise to deformation when supplementary operations are subsequently carried out on the components, such as turning over the edges, routing or punching. Further, since the forming action is applied by a fluid and not by a punch, a free space may be left in the thermoforming machine above the mold (or below the mold depending on the design of the mold). This free space may be used for housing tool arrangements for carrying out supplementary operations such as routing, punching or turning over the edges. In addition, by operating hot in the mold, the forces required for carrying out these further operations are much lower, which makes it possible to lighten the tool arrangements. Grouping further operations on the thermoforming machine in this manner may eliminate two or more presses in the lines for stamping automobile bodywork components. As a further advantage, the presently formed articles are formed at an elevated temperature and are aseptic when they issue from the mold and are directly ready for use for pharmaceutical or alimentary uses.

According to prior practice, thermoforming gives rise to serious problems with regard to removing the molded components from the mold, both as regards components of aluminum and as regards components of superplastic alloys. Very great care must be exercised in removing the molded components from the mold, the removal operation generally requiring a very long period of time as is set out, for example, in French Pat. No. 2,004,410. In order to permit thin-walled components, which are still hot and fragile, to be removed from the mold at industrial rates, the adhesion of the aluminum to the surface of the mold must be reduced. This is particularly important for the edges of the blanks, which edges are gripped between the edges of two-part molds. According to prior art practice, various techniques have been tried. As for stamping, it is possible to coat the surface of the blanks with a suitable substance, in most cases graphite-bearing oil. However, these mold removal substances give rise to disadvantages as regards subsequent treatments, even simply for a subsequent painting operation. These lubrication substances are particularly troublesome when the manufactured components are intended for alimentary use. They may give a disagreeable taste to the foods, especially if the foods are to be subjected to a cooking and sterilization treatment after they have been put into the plates or containers. It is also possible to coat the surface of the mold with various substances such as a foundry firing mixture (clay and resin). These substances are carried away by the manufactured components and must be renewed, which reduces the production rate. These various coating agents, whether they are on the blanks or on the mold, cause pollution of the surface of the components. Such agents therefore require the components to be subsequently cleaned and pickled after the components have been removed from the mold.

Faced with these difficulties, the industrial use of thermoforming has been limited hitherto, to the production of components of superplastic alloys, that is to say, production on a small scale at slow production rates, of the order of about ten articles per hour per mold.

Accordingly, it is a primary object of the invention to remedy the problem of removing articles from the mold and accordingly to permit the thermoforming process to be used in mass production operations. The invention makes possible the extension of the thermoforming process to the production of components of aluminum and magnesium of current compositions as indicated hereinbefore.

It has been found that it is possible to avoid the problems of adhesion between the components produced and the mold by forming a regular layer of artificially formed oxide, that is to say, as the case may be, a layer of alumina or magnesia, on the surface of the blank which is to come into contact with the mold, the layer being formed prior to the thermoforming operation. When aluminum is to be used according to the invention, an alumina layer formed electrolytically is found to be generally anhydrous and porous, and is suitable for the desired use. An alumina layer produced in this manner may be several microns in thickness. Alternatively a layer of alumina, referred to as boehmite, which is formed chemically, is generally monohydrated, hydration occurring at the same time as oxidation. In this case, oxidation quickly stops, and the thickness of the hydrated alumina layer does not exceed about 1 micron. Such a chemically formed layer of alumina is also suitable. In every case, whether the artificial alumina layer is anhydrous and porous or whether it is hydrated and compact, the alumina layer forms a homogenous, regular surface layer which adheres to the metal. The alumina layer prevents the aluminum from sticking at high temperature to the metal of the mold and obviates the necessity for providing lubrication before forming such as is required in stamping processes. The present invention also eliminates the necessity for any subsequent cleaning or pickling treatment. In addition, the hot-formed components formed according to the invention are perfectly aseptic and are suitable for foods without further treatment. The layer of alumina on the surface of the metal also facilitates the keying thereto of the lacquers, varnishes, plastic materials or metals which may be applied to the articles produced. It permits these materials to be applied to the articles without further surface treatment. Supplementary machining operations such as routing, punching, or turning down edges, may be effected in the hot condition in the mold according to the present invention without the addition of lubricant, the layer of alumina preventing adhesion between the tool and the metal of the aluminum article.

The process according to the invention may be used for continuous or discontinuous production. In continuous production, the thermoforming machine is part of an integrated production chain which may even include the station for preliminary anodic or chemical oxidation. In a discontinuous production process, the thermoforming machine is not an integral part of a production chain. It is very flexible in its use, for the production of various articles, from blanks which have been previously oxidized on their surface in another installation. Whether the process is continuous or discontinuous, the thermoforming machine may be supplied from a reel of metal of widely varying thickness, ranging from a thin sheet which is of the order of 0.10 mm in thickness, up to plate materials which are of the order of 2 to 3 mm in thickness. The machine may also be supplied with blanks which have been previously cut to length in the form of strips, sheets or plates of aluminum.

According to the present teaching, a layer of artificial alumina less than 0.10 micron in thickness has been shown to be in a thermoforming process to prevent the formed article from adhering to the mold. The alumina layer permits the formed article to be rapidly removed from the mold and makes it possible to use thermoforming for mass production operations at high rates of output. Further, good results have been obtained with alumina layers which are 0.04 micron in thickness. In contrast, tests performed with an alumina layer which is 0.01 micron in thickness were unsatisfactory as the thermoformed members were damaged when they were removed from the mold. However, it may be considered that the minimum thickness of the layer depends on the surface condition of the mold. It is probable that, by modifying the form of the mold and improving its surface condition, the mold removal operation would have been facilitated. However, such conditions would not be comparable to the operational environment encountered under normal industrial conditions. Thus, under normal industrial conditions, in order to remove the formed member easily, the alumina layers used are preferably of the order of from 0.4 micron to 1 micron in thickness. It would be possible to use thicker layers, additional costs with no real advantage would be encountered.

It is to be understood that an alumina layer formed by natural oxidation on the surface of aluminum blanks does not satisfactorily solve the problem caused by the adherence of thermoformed members to the surface of a mold.

In a similar manner, a surface layer of magnesia facilitates removal of thermoformed magnesium members from a mold.

It is therefore to be seen that the primary object of the invention is to prevent adherence of aluminum and magnesium articles to a mold in a thermoforming process as described, the particular advance in the art being the formation of alumina or magnesia layer on the surfaces of the articles as aforesaid.

Further objects and advantages of the invention will become more readily apparent in light of the following detailed description of the preferred embodiments of the invention.

DESCRIPTION OF THE PREFERRED EMBODIMENTS

Figure 1:
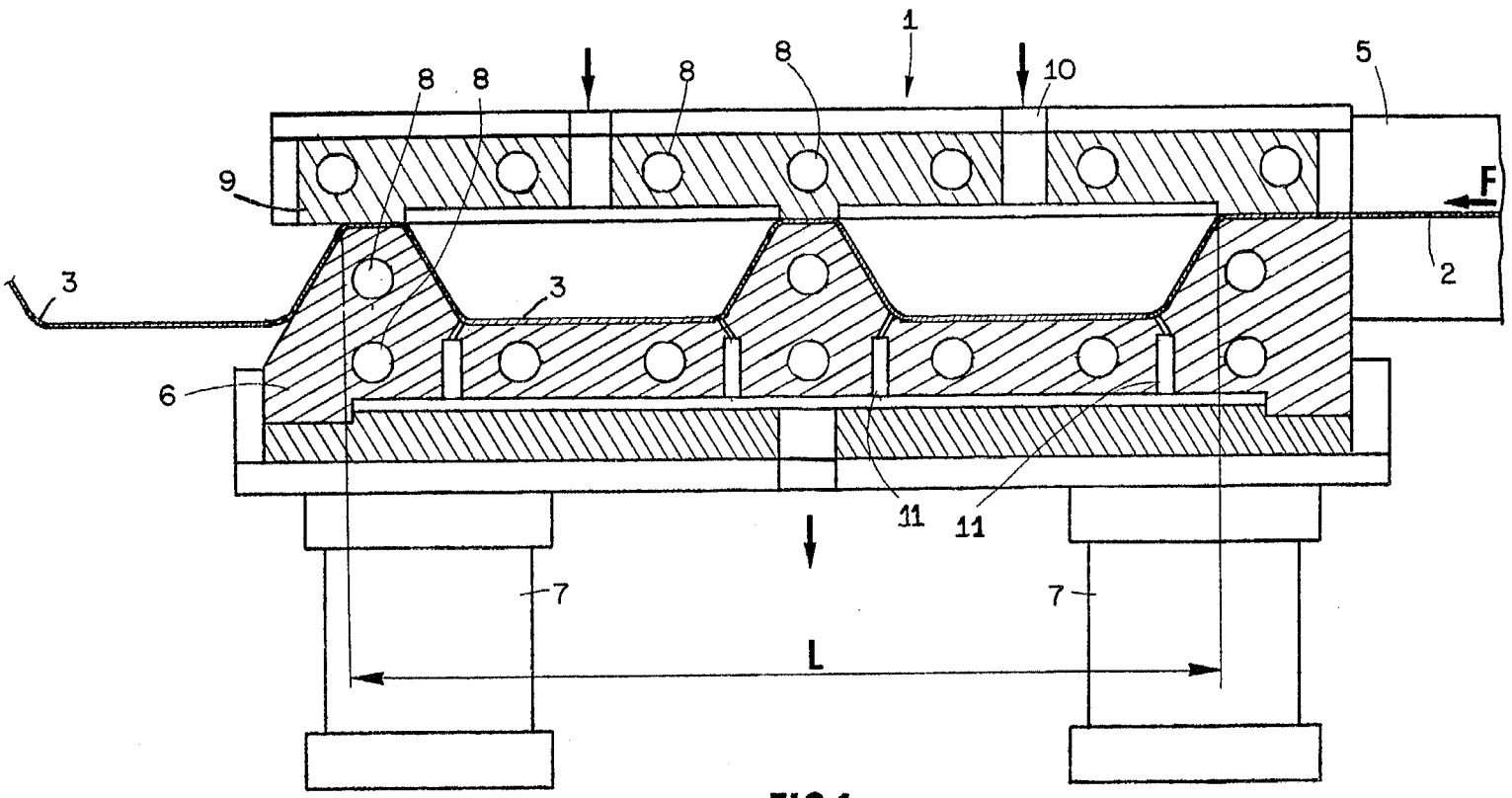
FIG. 1 is an elevational view in longitudinal section of a thermoforming mold having four recess cavities disposed in two parallel lines, each line comprising two cavities in series along the direction of movement of the sheet to be thermoformed, a sectional plane passing along the axis XX' of two such cavities arranged in series.

Referring to FIG. 1, there is shown a mold 1 which is in two parts and through which passes a sheet 2 which is fed forward periodically in the direction indicated by arrow F when the mold 1 is open. The sheet 2 is of aluminum alloy and is 400 mm in width and 0.14 mm in thickness. To permit the formed articles 3, which are in the form of trough-like containers, to be removed from the mold after the forming operation, the sheet 2 is covered on its two faces with a layer of alumina which is 0.05 micron in thickness. As indicated hereinabove, this layer of alumina on the surface of the sheet 2 may be formed by means of various known processes. The sheet 2 is taken to have an alumina layer produced thereon by anodic oxidation in a phosphoric solution such as is known in the art. The oxidation installation is diagrammatically illustrated at 4 in FIG. 2.

Figure 2:
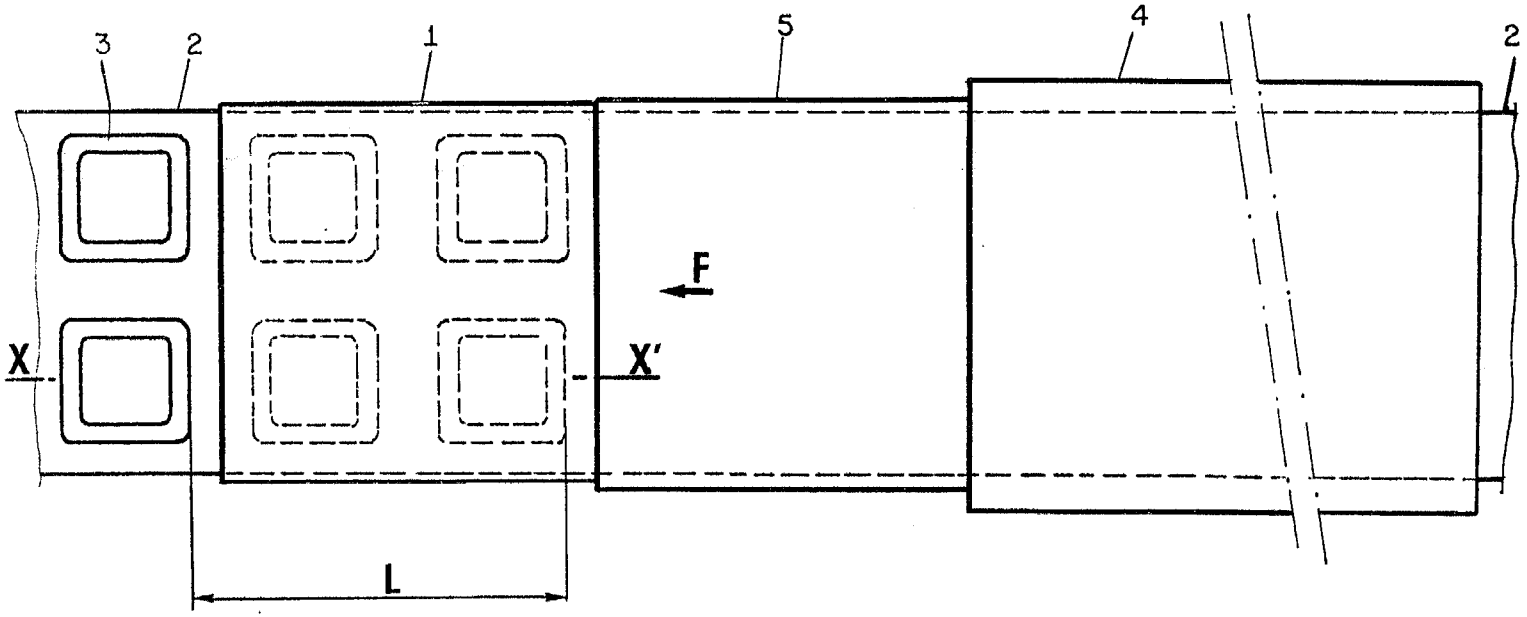
FIG. 2 is a diagrammatic plan view of an installation for oxidation, pre-heating and thermoforming, as a continuous operation, of a thin aluminum sheet which is displaced stepwise in the direction indicated by the arrow F; and, FIG. 3 is an elevational view in longitudinal section of a mold similar to that of FIG. 1, the mold comprising a supplementary tool arrangement for perforating the thermoformed member in the mold itself.

Before entering mold 1, the sheet 2 covered with its alumina layer is pre-heated to a temperature of from 470° to 530° C., according to the composition of the metal, in the installation diagrammatically illustrated at 5 in FIG. 2. The flexibility of the installation permits thermoforming of sheets of various alloys at temperatures of from 450° to 550° C. Pre-heating can be effected by means of electrically heated plates or by other known means, such as an electrically heated or gas-heated through-flow furnace, an induction furnace, etc.

For alloys which have structural hardening by precipitation, correct "solid dissolution" must be effected in the mold 1. For that purpose, the temperature must be adjusted with a degree of precision of plus or minus 2.5° C. and electrical heating means are preferred. These heating means will be arranged with care in order to provide a uniform temperature.

In a preferred practice of the invention, the mold 1 is raised to a temperature which is higher than the forming temperature, that is to say, generally about 100° C., above the forming temperature, the metal sheet 2 remaining at the forming temperature. As an example, for alloy 8011, whch is not capable of being hardened, the forming temperature is 470° C. while the temperature of the mold 1 is set at about 580° C.

For an alloy which is capable of being hardened or with structural hardening, the dissolution temperature of such an alloy is used as the forming temperature. Thus, for alloy 2002, the thermoforming temperature is 520° C., while the mold 1 is set at about 620° C. The mold 1 shown in FIG. 1 is preferably formed of steel which is commonly referred to as "hot non-deformable", the composition of this steel being substantially as follows:

C=0.5%;
Si=0.7%;
Cr=0.8%;
W=1.6%.

In the embodiment illustrated, the sheet 2 of alloy 8011, is moved stepwise in the direction indicated by arrow F, with a stepping distance L which corresponds to the spacing between the articles 3, at a frequency of 10 displacement steps per minute. Lower part 6 of the mold is mounted on two jacks 7 which make it possible for the lower part 6 to be moved downwardly during the forward movement of the sheet 2 in which the articles 3 are impressed. Electrical resistances 8 make it possible for both the lower part 6 and upper part 9 of the mold to be raised to a temperature of 580° C. When the sheet 2 is stopped and the lower part 6 of the mold is raised, air is progressively blown in by way of orifices 10 above the sheet 2 until a maximum pressure of 0.07 MPa is obtained. The pressure causes the aluminum sheet 2 to be applied to the four-cavity surface of the lower part 6 of the mold to thereby form four trough-shaped articles 3 simultaneously in each operation. The dimensions of the rectangular openings of the formed members are 150×135 mm, while their depth is 35 mm. The sides are inclined at an angle of 30°. The minimum thickness of the metal in the angles, after thermoforming, is of the order of 0.07 mm.

The duration of the forming operation proper is of the order of 2 seconds. The air in excess below the sheet 2 may escape freely by way of orifices 11. As soon as the members 3 have formed, by taking the shape of the mold, the air blown in by way of the orifices 10 is discharged to atmosphere and the lower part 6 of the mold moves downwardly, permitting the sheet 2 to move forward by a fresh length L. By virtue of the surface layer of alumina which was generated on the sheet 2 in the installation 4 before heating, the sheet 2 and the articles 3 do not adhere to the surfaces of the mold 1 whose heating does not have to be cut off. By virtue of the layer of alumina, the articles 3 are not damaged in the operation of removing them from the mold, even at their edges which are gripped between the upper and lower parts 6 and 9 respectively of the mold. The articles 3 and their edges are essentially at a temperature on the order of 470° C. when the members are removed from the mold, while the mold 1 is at a temperature of 580° C. The total production time does not typically exceed 6 seconds, including the periods of time for moving the sheet forward and closing and opening the mold 1. Thin members could equally well be formed by means of a vacuum applied below the sheet 2 by way of the orifices 11, as by a pressure applied by way of the orifices 10 in the upper part.

Upon leaving the mold 1, the formed articles 3 may be rapidly cooled, in the case of alloys which are capable of being hardened, by means of air, water or any other fluid, in order to effect hardening of the alloy. The formed articles 3 may also be partially cooled at a controlled speed and thus brought to a given temperature for the purposes of immediately carrying out another operation such as depositing a plastics material, a varnish or another metal.

Instead of subjecting the aluminum sheet 2, before heating, to anodic oxidation with attack on the metal, the aluminum sheet 2 may be passed into an aqueous solution of triethanolamine at a temperature of 100° C., which forms on the surface of the metal a layer of boehmite which is of the order of 0.05 micron in thickness and which, if the residence time is sufficient, may reach a thickness of 0.5 micron. This provides the same degree of ease in removing the formed members from the mold.

As may be seen, the layer of alumina permits production by thermoforming at industrial rates, without the many disadvantages which mold-removal additives would present.

Obviously, it would be possible to use molds and sheets of substantial width, making it possible to form large articles or a larger number of small articles in a parallel arrangement. In that case, the production rates can easily exceed 100 articles per minute, for small articles. As regards large articles, when a single article is formed per operation, the production rate will be limited to about 10 articles per minute.

Figure 3:
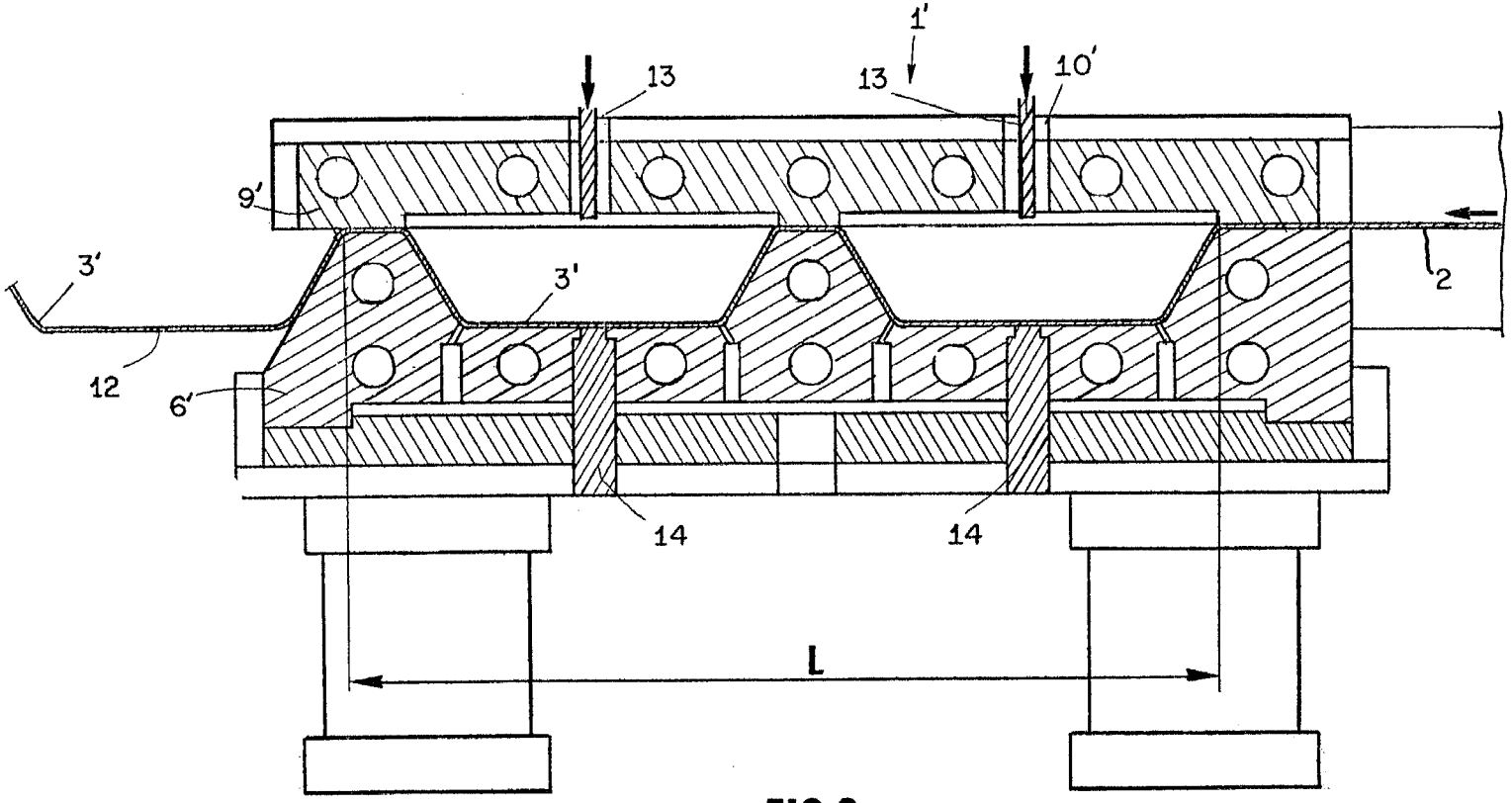

Referring to FIG. 3, there is shown a mold 1' which is intended to produce articles 3' similar to those of FIG. 1 but including a central perforation 12. Punch members 13 pass through orifices 10' which are of sufficient diameter to receive the punch members 13. The punch members 13 make it possible to pierce the bottom of the articles 3' before they are removed from the mold. For that purpose, lower part 6' of the mold comprises counter-punch members 14 which can move away when the punch members 13 move downwardly, after thermoforming the members 3'. It is thus possible to provide tool arrangements which make it possible to carry out various machining operations such as routing or turning down edges, in the mold 1' itself, thus allowing an increase in production rates and reduction in investment costs. By virtue of the layer of alumina, the punched metal does not adhere to the surface of the members 13 and 14.

The foregoing is intended as being illustrative of the invention, the scope of the invention including modifications to the explicit teachings detailed herein being defined by the appended claims.

What is claimed is:

1. A process for the production of articles from thin-walled blanks formed of aluminum, magnesium and alloys thereof, in a thermoforming mold, comprising the steps of:

forming a regular layer of artificial oxide on the surfaces of the blanks;

subjecting the blanks to a thermoforming process to include heating of the blanks and pressure forming of the heated blanks to deform the blanks against surfaces of the thermoforming mold to shape the blanks into said articles; and removing the shaped blanks from the mold, the regular artificial layer acting to facilitate removal of said shaped blanks from the mold.

2. In the process of claim 1, wherein a layer of alumina is formed on aluminum-based blanks and a layer of magnesia is formed on magnesium-based blanks.

3. In the process of claim 1, wherein the layer is more than 0.01 micron in thickness.

4. In the process of claim 1, wherein the layer is between 0.04 to 1.00 micron in thickness.

5. In the process of claim 1 wherein the thermoforming process is carried out at a temperature which is from 0.7 Tf to 0.9 Tf, Tf being the absolute melting temperature of the metal from which the blank is formed.

6. In the process of claim 1 wherein the layer of articifial oxide is formed by electrolytic oxidation.

7. In the process of claim 1 wherein the layer of artificial oxide is formed by chemical oxidation.

8. In the process of claim 1 wherein the layer of artificial oxide is produced continuously on the blanks in a continuous flow process upstream from the thermoforming process.

9. In the process of claim 1 wherein the layer of artificial oxide is formed on the blanks in a step-wise manner separately from the thermoforming process.

10. In the process of claim 6 wherein the blank comprises an aluminum-based material and wherein the layer comprises porous anhydrous alumina.

11. In the process of claim 7 wherein the blank comprises an aluminum-based material and wherein the layer comprises boehmite.

12. In the process of claim 1 wherein the articles produced are aseptic due to the temperature of formation thereof.

13. In the process of claim 1 wherein the articles produced are in a suitable condition for application thereto of plastic material, varnish, paint, and metal without further surface preparation.

14. In the process of claim 1 wherein the articles comprise industrial articles such as automobile bodywork components or articles for covering fronts of buildings, the improvement further comprising the step of:

utilizing supplementary tool arrangements such as those for punching, routing, and turning edges on the thermoforming machine, which tool arrangements may operate in a hot condition without lubrication by virtue of the layer of oxide.

15. The process of claim 1 wherein the mold is maintained during the thermoforming step at a temperature higher than the temperature of the blank.

16. The process of claim 15 wherein the temperature of the mold is approximately 100° C. higher than the temperature of the blank.

17. The process of claim 15 wherein the alloy is not capable of being hardened, the temperature of the mold being held at approximately 580° C. and the temperature of the blank being held at approximately 470° C.

18. The process of claim 17 wherein the alloy is Alloy 8011.

19. The process of claim 15 wherein the alloy is capable of being hardened, the temperature of the mold being held at approximately 620° C. and the temperature of the blank being held at approximately 520° C.

20. The process of claim 19 wherein the alloy is Alloy 2002.

21. The process of claim 15 wherein the alloy is capable of being hardened, the temperature of the alloy during the thermoforming step being the dissolution temperature of the alloy.

22. The process of claim 21 wherein the temperature of the mold is held at approximately 100° C. above the dissolution temperature of the blank.

23. The process of claim 1 wherein the mold is formed of a material different from the material from which the blanks are formed.

24. The process of claim 23 wherein the mold is formed of a hot, non-deformable steel.

* * * * *